US009947428B2

(12) United States Patent
Tsuji et al.

(10) Patent No.: US 9,947,428 B2
(45) Date of Patent: Apr. 17, 2018

(54) ATOMIC BEAM SOURCE

(71) Applicant: NGK INSULATORS, LTD., Nagoya (JP)

(72) Inventors: Hiroyuki Tsuji, Nagoya (JP); Tomonori Takahashi, Chita (JP); Yoshimasa Kondo, Nagoya (JP); Kazumasa Kitamura, Ichinomiya (JP); Takayoshi Akao, Kasugai (JP); Tomoki Nagae, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 0 days.

(21) Appl. No.: 15/429,408

(22) Filed: Feb. 10, 2017

(65) Prior Publication Data

US 2017/0154697 A1 Jun. 1, 2017

Related U.S. Application Data

(63) Continuation of application No. PCT/JP2016/074059, filed on Aug. 18, 2016.

(30) Foreign Application Priority Data

Aug. 28, 2015 (JP) ..... 2015-168429

(51) Int. Cl.
*G21G 4/00* (2006.01)
*G21K 5/00* (2006.01)

(52) U.S. Cl.
CPC ..... *G21K 5/00* (2013.01)

(58) Field of Classification Search
CPC ..... G21J 5/00; G21J 5/02; G21J 5/04; H01J 49/00; H01J 49/02; H01J 49/10; H01J 49/105

(Continued)

(56) References Cited

U.S. PATENT DOCUMENTS 5,006,706 A * 4/1991 Marcus ..... G01N 21/68 250/281
6,285,025 B1 * 9/2001 Metel ..... H01J 27/08 250/251

FOREIGN PATENT DOCUMENTS

JP 63-143799 A1 6/1988
JP 05-315099 A1 11/1993

(Continued)

OTHER PUBLICATIONS

International Search Report and Written Opinion (Application No. PCT/JP2016/074059) dated Nov. 1, 2016.

(Continued)

*Primary Examiner* — Jason McCormack
(74) *Attorney, Agent, or Firm* — Burr & Brown, PLLC

(57) ABSTRACT

An atomic beam source includes a tubular cathode that includes an emission portion that includes an emission port through which an atomic beam can be emitted, a rod-shaped first anode disposed inside the cathode, and a rod-shaped second anode disposed inside the cathode and spaced from the first anode. At least one selected from the group consisting of a shape of the cathode, a shape of the first anode, a shape of the second anode, and a positional relationship between the cathode, the first anode, and the second anode is predetermined so that emission of sputter particles resulting from collision of cations, which have been generated by plasma between the first anode and the second anode, with at least one selected from the cathode, the first anode, and the second anode is reduced.

10 Claims, 7 Drawing Sheets

(58) Field of Classification Search
USPC ..... 250/493.1, 251, 288
See application file for complete search history.

(56) References Cited

FOREIGN PATENT DOCUMENTS

| | | | | |
|---|---|---|---|---|
| JP | 08-190995 | A1 | | 7/1996 |
| JP | 08-250295 | A1 | | 9/1996 |
| JP | 2007-317650 | A1 | | 12/2007 |
| JP | 2008-281346 | A1 | | 11/2008 |
| JP | 2008281346 | A | * | 11/2008 |
| JP | 2014-086400 | A1 | | 5/2014 |

OTHER PUBLICATIONS

English Translation of International Search Report, International Application No. PCT/JP2016/074059, dated Nov. 1, 2016 (2 pages).

* cited by examiner

ATOMIC BEAM SOURCE

BACKGROUND OF THE INVENTION

1. Field of the Invention

The present invention relates to an atomic beam source.

2. Description of the Related Art

As a type of atomic beam sources, one that controls the electron density in the discharge space by displacing an anode placed inside a tubular body serving as a cathode has been proposed in the related art (refer to PTL 1). It is described in PTL 1 that the atomic beam source can obtain a desired emitted atom density distribution per unit time at a low cost in a short time and, if used in a surface modifying apparatus, enables excellent surface treatment.

According to the atomic beam source of PTL 1, the cathode and the anode become sputtered by ions or the like generated in the discharge space and particles fallen therefrom are sometimes emitted from the atomic beam source. Thus, there has been proposed an atomic beam source that includes a casing that serves as a cathode and an electrode body that is disposed in the casing and serves as an anode that generates an electric field, in which at least part of the casing or the electrode body is formed of a material that can resist being sputtered by ions generated by the electric field (refer to PTL 2). It is described that the atomic beam source of PTL 2 can suppress emission of unnecessary particles.

CITATION LIST

Patent Literature

PTL 1: JP 2007-317650 A
PTL 2: JP 2014-86400 A

SUMMARY OF THE INVENTION

However, while the atomic beam source of PTL 2 can reduce emission of unnecessary particles due to use of a difficult-to-sputter material, it cannot completely prevent emission of unnecessary particles. Thus, further reduction of emission of unnecessary particles has been desired.

The present invention has been made to resolve the above-described issue. A main object thereof is to provide an atomic beam source that can further reduce emission of unnecessary particles.

The atomic beam source according to the present invention has employed following measures to achieve the main object.

An atomic beam source according to the present invention comprises a tubular cathode that includes an emission portion that includes an emission port through which an atomic beam can be emitted;

a rod-shaped first anode disposed inside the cathode; and a rod-shaped second anode disposed inside the cathode and spaced from the first anode, wherein at least one selected from the group consisting of a shape of the cathode, a shape of the first anode, a shape of the second anode, and a positional relationship between the cathode, the first anode, and the second anode is predetermined so that emission of sputter particles resulting from collision of cations, which have been generated by plasma between the first anode and the second anode, with at least one selected from the cathode, the first anode, and the second anode is reduced.

According to the atomic beam source of the present invention, emission of unnecessary particles can be further reduced. The reasons for such an effect is presumed as follows. That is, by predetermining the shape of the cathode, the shape of the anodes, the positional relationship between the cathode, the first anode, and the second anode, etc., generation of the sputter particles can be directly reduces, deposition of sputter particles can be reduced, falling or scattering of generated sputter particles from the cathode and the anodes can be reduced, and emission of fallen or scattered sputter particles can be reduced.

DETAILED DESCRIPTION OF THE INVENTION

First Embodiment

Figure 1:
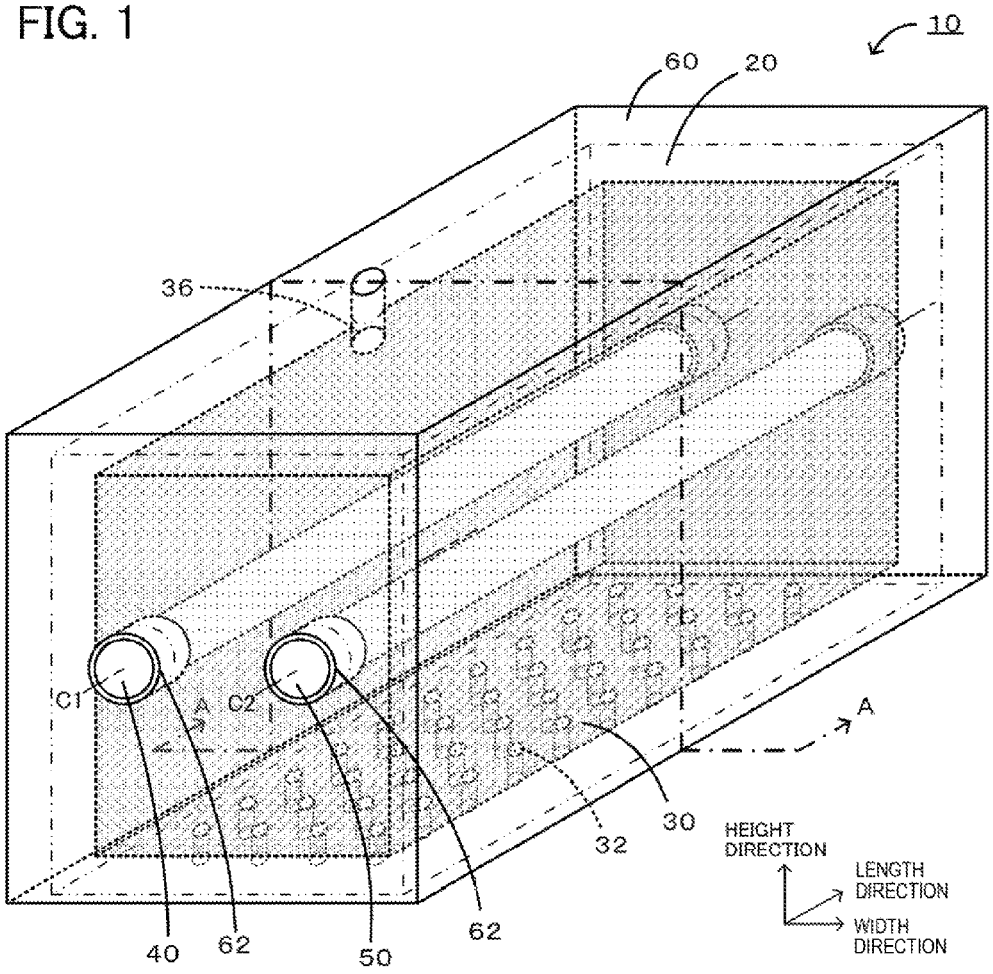
FIG. 1 is a schematic perspective view of a structure of an atomic beam source 10, which is one example of a first embodiment.
Figure 2:
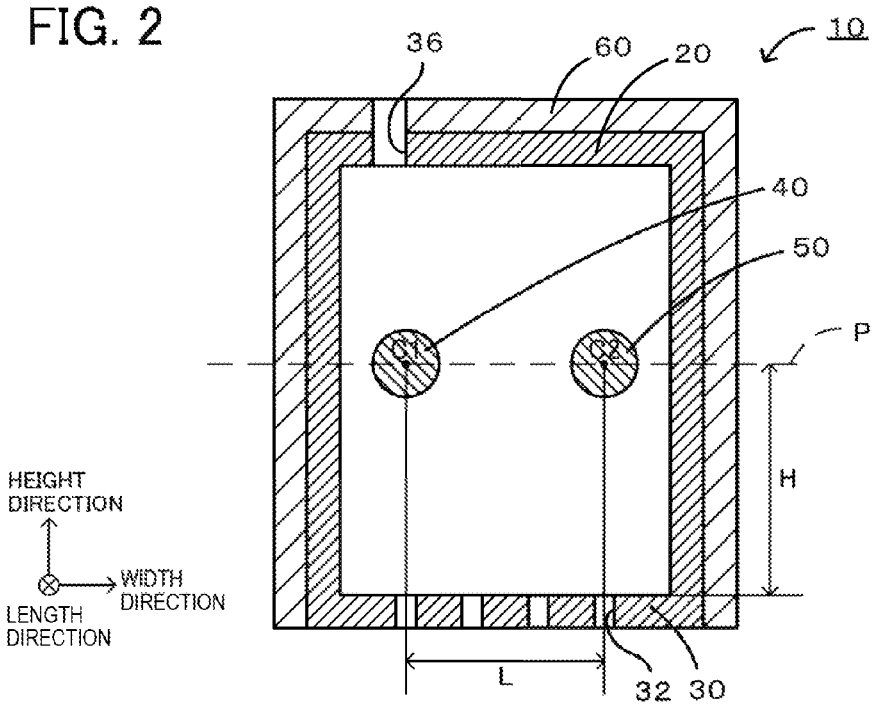
FIG. 2 is a cross-sectional view taken along line A-A in FIG. 1.
Figure 3:
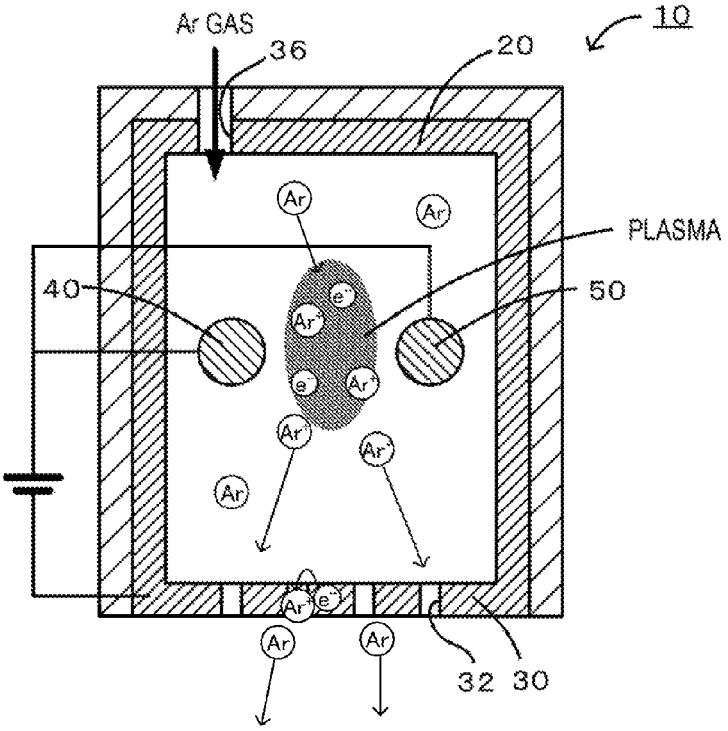
FIG. 3 is a diagram that illustrates the state of the atomic beam source 10 in operation.

FIG. 1 is a schematic perspective view of a structure of an atomic beam source 10, which is one example of a first embodiment. FIG. 2 is a cross-sectional view taken along line A-A in FIG. 1. FIG. 3 is a diagram that illustrates the state of the atomic beam source 10 in operation.

As illustrated in FIGS. 1 and 2, the atomic beam source 10 includes a tubular cathode 20 having both ends closed, a rod-shaped first anode 40 disposed inside the cathode 20, and a rod-shaped second anode 50 disposed inside the cathode 20 and spaced from the first anode 40. The cathode 20 includes an emission portion 30 in which multiple emission ports 32 through which atomic beams can be emitted are formed, and the emission portion 30 is formed in a portion of a surface of the tubular body. The cathode 20 is housed inside a casing 60 that has an open portion corresponding to this emission portion 30. The cathode 20 also includes a supply portion 36 in a surface opposite the emission portion 30 and source gas (for example, Ar gas) is supplied through the supply portion 36. Each of the first anode 40 and the second anode 50 has both ends respectively fixed to one end and the other end of the cathode 20 with an insulating member 62 therebetween. In FIG. 1, the border lines between the casing 60 and the cathode 20 are indicated by two-dot chain lines and the inner surfaces of the cathode 20 are hatched.

In use, the atomic beam source 10 is placed in a reduced-pressure atmosphere of, for example, $10^{-2}$ Pa or less and preferably $10^{-3}$ Pa or less. As illustrated in FIG. 3, the cathode 20 is connected to the negative electrode of a DC power supply and the first anode 40 and the second anode 50 are connected to the positive electrode of the DC power supply. For example, a high voltage of about 0.1 kV to 10 kV is applied. An electrical field created as such ionizes the source gas supplied through the supply portion 36 and plasma is generated between the first anode 40 and the second anode 50. Cations (for example, $Ar^+$) generated by the plasma are attracted to the emission portion 30, pass through the emission ports 32, receive electrons from the cathode 20, and go out as atomic beams (for example, Ar beams). Thus, this device functions as an atomic beam source.

In the atomic beam source 10, the first anode 40 and the second anode 50 are arranged parallel to each other so that center axes C1 and C2 are on a particular installation plane P parallel to the emission portion 30. The first anode 40 and the second anode 50 are arranged so that the value of $(H+L)\times H^2/L$ is in the range of 750 or more and 1670 or less where L represents a distance between the center axes C1 and C2 and H represents a distance between the installation plane P and the emission portion 30. The value of $(H+L)\times H^2/L$ is preferably 750 or more, more preferably 800 or more, and yet more preferably 850 or more. The value of the $(H+L)\times H^2/L$ is preferably 1670 or less, more preferably 1050 or less, and yet more preferably 1000 or less. The distance L between the center axes C1 and C2 is, for example, preferably 10 mm or more and 50 mm or less, more preferably 12 mm or more and 40 mm or less, and yet more preferably 12 mm or more and 35 mm or less. The distance H between the installation plane P and the emission portion 30 is, for example, preferably 10 mm or more and 50 nm or less, more preferably 15 mm or more and 45 mm or less, and yet more preferably 20 mm or more and 30 mm or less. The first anode 40 and the second anode 50 are preferably arranged such that the center axes C1 and C2 are parallel to the axis direction of the cathode 20. Preferably, the middle position between the center axes C1 and C2 is coincident with the position of the center of the cathode 20 in the width direction. More preferably, the difference is within 5 mm.

The shape of the cathode 20 in a cross section perpendicular to the axis direction of the cathode 20 may be circular, elliptic, or polygonal such as triangular, rectangular, pentagonal, or hexagonal, or may be any other shape. The cathode 20 may have the same or different cross-sectional shapes on the inner side and the outer side. The dimensions of the cathode on the inner side thereof are, for example, 20 mm or more and 100 mm or less in the height direction, 20 mm or more and 100 mm or less in the width direction, and 50 mm or more and 300 mm or less in the length direction. The height direction is a direction perpendicular to the plane in which the emission portion 30 is formed, the width direction is a direction perpendicular to the vertical direction and perpendicular to the axis direction, and the length direction is a direction parallel to the axis direction of the cathode 20 (the same applies hereinafter). The thickness of the cathode 20 may be 0.5 mm or more and 10 mm or less, for example.

The material for the cathode 20 can be a carbon material such as graphite or glassy carbon. Carbon material is suitable since it has a good electron emitting property, is inexpensive, and has good workability. Examples of the material for the cathode 20 include, in addition to these, tungsten, molybdenum, titanium, nickel, and alloys and compounds thereof.

The emission portion 30 may be formed in a region that extends in the length direction by having a predetermined width. For example, when the cross-sectional shape on the inner side of the cathode 20 is polygonal, the emission portion 30 may be formed in one of the surfaces. The dimensions of the emission portion 30 may be 5 mm or more and 90 mm or less in width and 5 mm or more and 90 mm or less in length, for example. The emission portion 30 may be divided into plural sections. The shape of the emission ports 32 may be circular, elliptic, or polygonal such as triangular, rectangular, pentagonal, or hexagonal, or may be any other shape. The dimensions of the emission ports 32 in the width direction and the length direction (diameter in the case of a circle) may be 0.05 mm or more and 5 mm or less. The emission ports 32 may have a slit shape having a width of 0.05 mm or more and 5 mm or less. The thickness of the emission portion 30 may be 0.5 mm or more and 10 mm or less and may be the same as or different from the thickness of other parts of the cathode 20. Examples of the material for the emission portion 30 may be the same as those for the cathode 20. The material for the emission portion 30 may be the same as or different from that for the emission portion 30.

A supplying device not shown in the drawing and configured to supply source gas is connected to the supply portion 36. The position, dimensions, shape, etc., of the supply portion 36 are not particularly limited and may be appropriately set to stabilize plasma.

The casing 60 may be any casing that covers at least parts of the cathode 20 other than the emission portion 30. Preferably, the casing 60 covers all parts of the cathode 20 other than the emission portion 30 and the supply portion 36. The material for the casing 60 can be an aluminum alloy, a copper alloy, stainless steel, or the like.

The shape of the first anode 40 and the second anode 50 in a cross section perpendicular to the axis direction of the cathode 20 may be circular, elliptic, or polygonal such as triangular, rectangular, pentagonal, or hexagonal, or may be any other shape. The dimensions of the first anode 40 and the second anode 50 are not particularly limited. For example, the dimensions may be 1 mm or more and 20 mm or less in the height direction and the width direction (diameter in the case of a circle) and 50 mm or more and 400 mm or less in the length direction. The shape and dimensions may be the same or different between the first anode 40 and the second anode 50.

The material for the first anode 40 and the second anode 50 can be a carbon material such as graphite or glassy carbon. Carbon material is suitable since it has a good electron emitting property, is inexpensive, and has good workability. Other examples of the material for the first anode 40 and the second anode 50 include tungsten, molybdenum, titanium, nickel, and alloys and compounds thereof.

In this atomic beam source 10, a workpiece placed in a process chamber in a reduced-pressure atmosphere is irradiated with an atomic beam so as to process the workpiece as desired. The process chamber is preferably set to $10^{-2}$ Pa or less and more preferably $10^{-3}$ Pa or less. Examples of the workpiece include metals and compounds such as Si, $LiTaO_3$, $LiNbO_3$, SiC, $SiO_2$, $Al_2O_3$, GaN, GaAs, and GaP. The atomic beam source 10 is capable of removing oxides and adsorbent molecules on the surface of the workpiece and activating the workpiece surface through atomic beam irradiation. For example, surfaces of two workpieces can be irradiated with an atomic beam to remove oxides and adsorbent molecules and activate the surfaces, the workpieces may be superimposed on each other with the atomic-beam-irradiated surfaces facing each other, and if needed, pressure is applied to directly join the two workpieces. The atomic beam source 10 can be used as a so-called fast atomic beam (FAB) source.

According to the atomic beam source 10 described so far, the positional relationship between the cathode 20, the first anode 40, and the second anode 50 is predetermined. Specifically, the value of the $(H+L)\times H^2/L$ is 750 or more and 1670 or less. When the value of the $(H+L)\times H^2/L$ is 750 or more and 1670 or less, the atomic beam output efficiency is improved and thus the output of the DC power source needed to obtain the desired atomic beam output efficiency can be decreased. As a result, the percentage of the cations colliding with parts of the cathode 20 other than the emission portion 30 is decreased and the number of colliding cations is decreased due to a lower DC power supply output. Thus, according to the atomic beam source 10, generation of sputter particles can be suppressed while maintaining the atomic beam output efficiency. Thus, emission of unnecessary particles can be further reduced.

Second Embodiment

Figure 4:
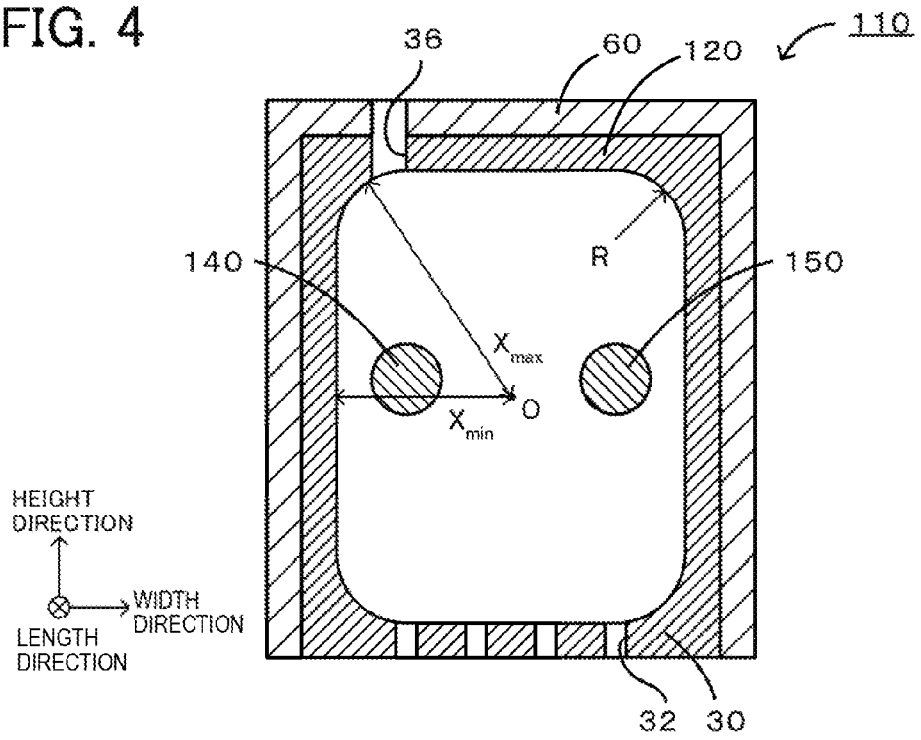
FIG. 4 is a cross-sectional view of an atomic beam source 110, which is one example of a second embodiment, and is equivalent to FIG. 2.

FIG. 4 is a cross-sectional view of an atomic beam source 110, which is one example of a second embodiment, and is equivalent to FIG. 2. The structure identical to the structure of the atomic beam source 10 is referred to by the same reference numeral and the detailed description therefor is omitted. The structure not illustrated in FIG. 4 is identical to the structure of the atomic beam source 10; thus, a perspective view is not provided. The method of using the atomic beam source and the method for processing the workpiece by using the atomic beam source are the same as those for the atomic beam source 10; thus, descriptions therefor are omitted (the same applies to other embodiments below).

As illustrated in FIG. 4, the atomic beam source 110 includes a tubular cathode 120 having both ends closed, a rod-shaped first anode 140 disposed inside the cathode 120, and a rod-shaped second anode 150 disposed inside the cathode 120 and spaced from the first anode 140. The cathode 120 includes an emission portion 30 in which multiple emission ports 32 through which atomic beams can be emitted are formed, and the emission portion 30 is formed in a portion of a surface of the tubular body. The cathode 120 is housed inside a casing 60 that has an open portion corresponding to this emission portion 30. The cathode 120 also includes a supply portion 36 in a surface opposite the emission portion 30. Each of the first anode 140 and the second anode 150 has both ends respectively fixed to one end and the other end of the cathode 120 with an insulating member 62 therebetween. For the atomic beam source 110, the value of $(H+L)\times H^2/L$ may be the same as or different from that of the atomic beam source 10. For example the value may be appropriately set within the range of 500 or more and 4000 or less.

In the atomic beam source 110, the shape of the cathode 120 in a cross section perpendicular to the axis direction of the cathode 120 is rectangular on the inner side, and each corner of the rectangle has an edge-truncated shape, specifically, an R surface. The rectangle is preferably a square or an oblong. The R surface preferably has a radius of 1 mm or more, more preferably 5 mm or more, and yet more preferably 10 mm or more. The R surface may have a radius of 50 mm or less, 30 mm or less, or 20 mm or less. In a cross section of the cathode 120 taken perpendicular to the axis direction of the cathode 120, the minimum distance Xmin from the center O to the inner side and the maximum distance Xmax from the center O to the inner side preferably satisfy $0.5 \leq Xmin/Xmax \leq 1$. In this manner, emission of unnecessary particles can be further reduced. The center O may be the position of the center of the gravity of the rectangle on the inner side in a cross section perpendicular to the axis direction of the cathode 120. The value of Xmin/Xmax is preferably 0.68 or more and more preferably 0.7 or more. The dimensions of the cathode 120 may be, for example, 20 mm or more and 100 mm or less in the height direction, 20 mm or more and 100 mm or less in the width direction, and 50 mm or more and 300 mm or less in the length direction.

In a cross section perpendicular to the axis direction of the cathode 120, the shape of the outer side of the cathode 120 may be circular, elliptic, or polygonal such as triangular, rectangular, pentagonal, or hexagonal, or may be any other shape. The cross-sectional shape may be the same or different between the inner side and the outer side of the cathode 120. The thickness of the cathode 20 may be 0.5 mm or more and 10 mm or less. Examples of the material for the cathode 120 are the same as those for the cathode 20.

The first anode 140 and the second anode 150 may be arranged parallel to each other so that their center axes are on a particular installation plane parallel to the emission portion 30. At least one of the center axes may be arranged to incline in the vertical direction with respect to the installation plane P, for example, and/or at least one of the center axes may be arranged to incline in the width direction with respect to a plane perpendicular to the width direction, for example. The slope of the center axis with respect to the installation plane P may be, for example, 0° or more and 10° or less. The slope of the center axis with respect to the plane perpendicular to the width direction may be, for example, 0° or more and 10° or less. The shape, dimensions, and material for the first anode 140 and the second anode 150 may be the same as those for the first anode 40 and the second anode 50.

According to the atomic beam source 110 described herein, the shape of the cathode 120 is predetermined. Specifically, the cathode 120 has corners having an edge-truncated shape. While sputter particles tend to deposit on the corners, concentration of deposition of the sputter particles on the corners can be reduced due to the edge-truncated corners of the cathode 120. Thus, the thickness of the layer of the sputter particles deposited within the cathode 120 can be made more uniform, generation of cracks due to strain can be reduced, and falling and scattering of the deposits can be reduced. Moreover, while portions close to plasma (for example, portions other than the corners of the cathode) are generally susceptible to wear due to collision with cations, the edge-truncated corners of the cathode 120 are closer to plasma than in the case where the corners are not edge-truncated, and thus the distance between the cathode 120 and the plasma is made more uniform and the amount of wear also becomes more uniform. As such, with the atomic beam source 110, the amount of deposits on the cathode 120 and the amount of wear of the cathode 120 due to collision with cations become more uniform, and growth of the deposits that may fall off or scatter can be directly reduced. As a result, emission of unnecessary particles can be reduced.

Figure 5:
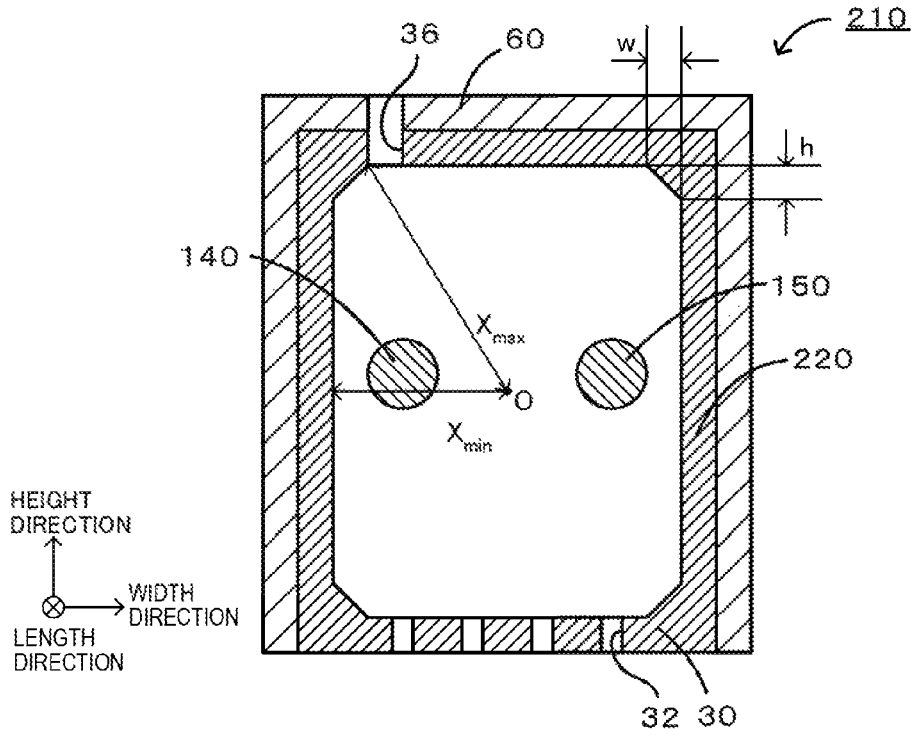
FIG. 5 is a cross-sectional view of an atomic beam source 210, which is another example of the second embodiment, and is equivalent to FIG. 2

In the atomic beam source 110, the shape of the cathode 120 in a cross section perpendicular to the axis direction of the cathode 120 is rectangular on the inner side and each corner of the rectangle has an R surface; alternatively, each corner may have a chamfer surface. In this manner also, the same effects as those of the atomic beam source 110 can be obtained. FIG. 5 is a cross-sectional view of an atomic beam source 210, which is another example of the second embodiment, and is equivalent to FIG. 2. The same structure as that of the atomic beam source 110 is referred to by the same reference numeral and the detailed description therefor is omitted. In the atomic beam source 210, the height h and the width w of the chamfer surface may each be greater than 10 mm and more preferably 15 mm or more. The height h and width w of the chamfer surface may each be 50 mm or less, 30 mm or less, or 20 mm or less. In the atomic beam source 210 also, the rectangle is preferably a square or an oblong. In a cross section of a cathode 220 taken perpendicular to the axis direction of the cathode 220, the minimum distance Xmin from the center O to the inner side and the maximum distance Xmax from the center O to the inner side preferably satisfy $0.5 \leq Xmin/Xmax \leq 1$. The value of Xmin/Xmax may be 0.68 or more or 0.7 or more and is preferably greater than 0.75, preferably 0.77 or more, and more preferably 0.79 or more.

In the atomic beam source 110 and the atomic beam source 210, the inner side of the cathode has a rectangular shape with edge-truncated corners in a cross section perpendicular to the axis direction of the cathode; alternatively, for example, the shape of the inner side of the cathode may be circular or elliptic in the cross section perpendicular to the axis direction of the cathode. In this manner also, the same effects as those of the atomic beam source 110 and the atomic beam source 210 can be obtained. In this case also, in the cross section perpendicular to the axis direction of the cathode, the minimum distance Xmin from the center O to the inner side and the maximum distance Xmax from the center O to the inner side preferably satisfy $0.5 \leq Xmin/Xmax \leq 1$. The value of Xmin/Xmax may be 0.68 or more or 0.7 or more. In this case, the position of the center O may be the center of a circle or ellipse on the inner side in a cross section perpendicular to the axis direction of the cathode.

Third Embodiment

Figure 6:
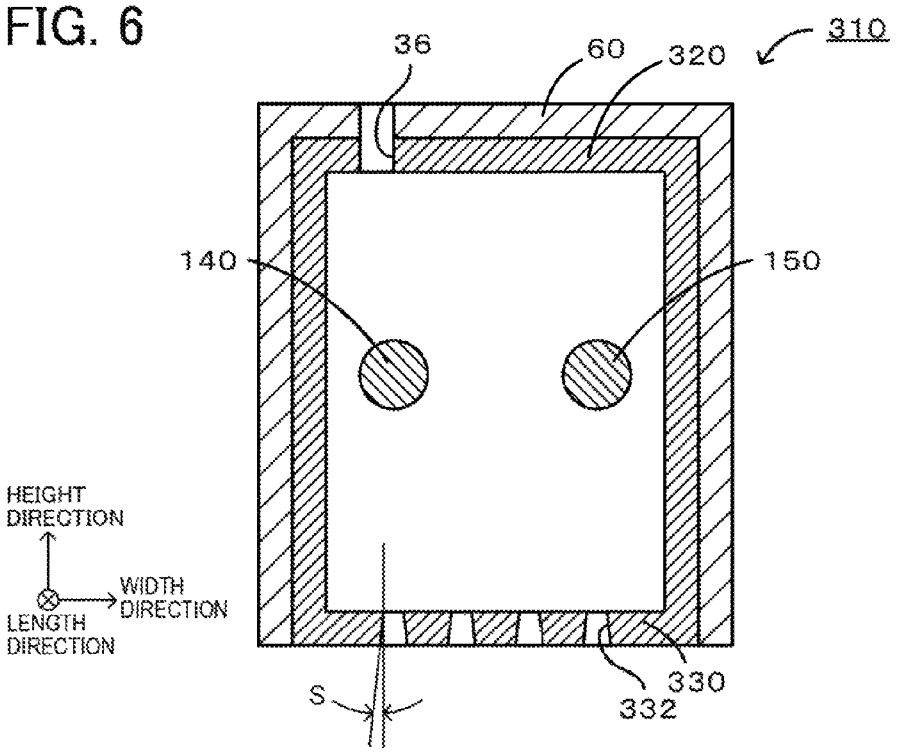
FIG. 6 is a cross-sectional view of an atomic beam source 310, which is one example of a third embodiment, and is equivalent to FIG. 2.

FIG. 6 is a cross-sectional view of an atomic beam source 310, which is one example of a third embodiment, and is equivalent to FIG. 2. The structure identical to the atomic beam source 10 or the atomic beam source 110 is referred to by the same reference numeral and detailed description therefor is omitted.

As illustrated in FIG. 6, the atomic beam source 310 includes a tubular cathode 320 having both ends closed, a rod-shaped first anode 140 disposed inside the cathode 320, and a rod-shaped second anode 150 disposed inside the cathode 320 and spaced from the first anode 140. The cathode 320 includes an emission portion 330 in which multiple emission ports 332 through which atomic beams can be emitted are formed. The emission portion 330 is disposed in a portion of a surface of the tubular body. The cathode 320 is disposed inside a casing 60 that has an open portion corresponding to this emission portion 330. The cathode 320 also includes a supply portion 36 in a surface opposite the emission portion 330. Each of the first anode 140 and the second anode 150 has both ends respectively fixed to one end and the other end of the cathode 320 with an insulating member 62 therebetween.

In the atomic beam source 310, the emission ports 332 formed in the emission portion 330 of the cathode 320 are formed to have a tendency in which the opening area decreases from the outer surface toward the inner surface of the cathode 320. For each emission port, the slope S of the straight line connecting the outer surface to the inner surface with respect to the direction perpendicular to the emission portion 330 is to be greater than 0°, preferably 4° or more, and more preferably 6° or more. When the slope S is greater than 0°, the opening area on the inner surface side can be made smaller and the opening area on the outer surface side can be made larger than in the case where the slope S is 0°, for example. As a result, according to the atomic beam source 310, emission of sputter particles can be reduced on the inner surface side and a decrease in the atomic beam output efficiency can be reduced since the opening on the outer surface side is larger than the opening on the inner surface side and cations and atoms are less likely to collide with the emission ports 332. The slope S is preferably 20° or less, more preferably 15° or less, and yet more preferably 10° or less. As long as the slope S is 20° or less, the opening on the inner surface side is not excessively small and adjacent ports are prevented from becoming connected to each other. The tendency in which the opening area decreases from the outer surface toward the inner surface of the cathode 320 may be one in which the opening area decreases linearly from the outer surface toward the inner surface at a particular angle, may be one in which the opening area decreases by forming a curved profile at varying angles, or may be one in which the opening area changes stepwise. The slope S may be constant throughout the entire circumference of each emission port 332, or vary.

The shape of the emission ports 332 may be circular, elliptic, or polygonal, such as triangular, rectangular, pentagonal, or hexagonal, or may be any other shape. The dimensions of the emission ports 332 may be 0.05 mm or more and 5 mm or less in the width direction and the length direction (diameter in the case of a circle) at the inner surface of the cathode 320, for example. The emission ports 32 may have a slit shape. In the case of the slit shape, the slit preferably has a width of 0.05 mm or more and 5 mm or less at the inner surface of the cathode 320. The direction in which the slit extends is not particularly limited.

The shape, dimensions, material, and position of the emission portion 330 may be the same as those of the emission portion 30 except for the emission ports 332. The shape, dimension, material, etc., of the cathode 320 may be the same as those of the cathode 20 except for the emission portion 330 and the emission ports 332.

In the atomic beam source 310 described above, the shape of the cathode 320 is predetermined. Specifically, the emission ports 332 formed in the emission portion 330 of the cathode 320 are formed to have a tendency in which the opening area decreases from the outer surface toward the inner surface of the cathode 320. As such, in the atomic beam source 310, since the opening area on the inner surface side is smaller, emission of sputter particles can be reduced at the inner surface side. Moreover, since the opening at the outer surface side is larger than the opening at the inner surface side and cations and atoms are less likely to collide with the emission ports 332, the decrease in atomic beam output efficiency can be reduced. As a result, emission of unnecessary particles can be reduced.

Fourth Embodiment

Figure 7:
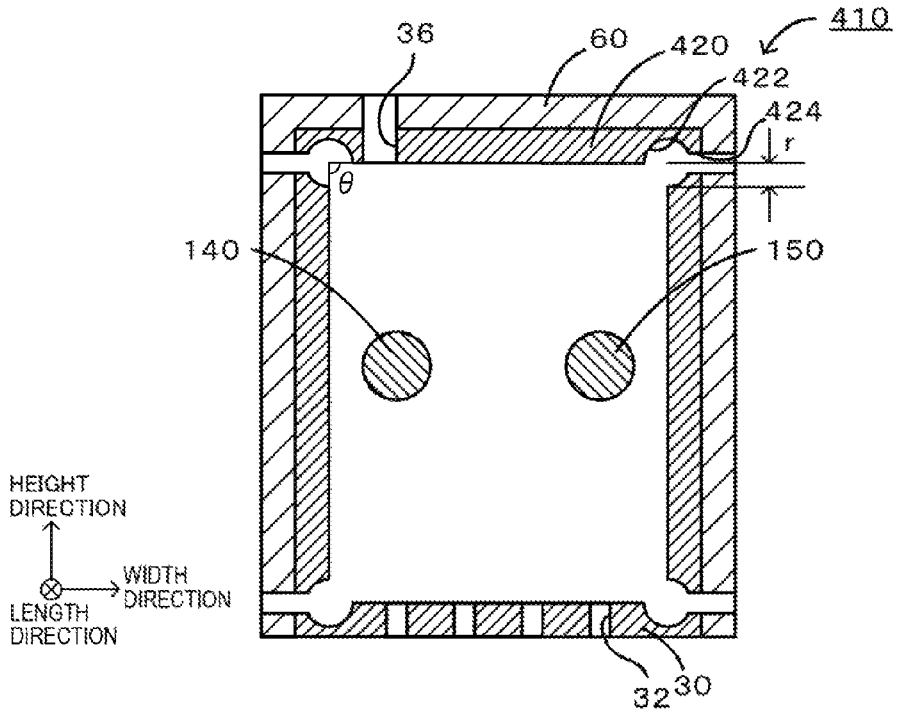
FIG. 7 is a cross-sectional view of an atomic beam source 410, which is one example of a fourth embodiment, and is equivalent to FIG. 2.

FIG. 7 is a cross-sectional view of an atomic beam source 410, which is one example of a fourth embodiment, and is equivalent to FIG. 2. The structure identical to the structure of the atomic beam source 10 or the atomic beam source 110 is referred to by the same reference numeral and the detailed description therefor is omitted.

As illustrated in FIG. 7, the atomic beam source 410 includes a tubular cathode 420 having both ends closed, a rod-shaped first anode 140 disposed inside the cathode 420, and a rod-shaped second anode 150 disposed inside the cathode 420 and spaced from the first anode 140. The cathode 420 includes an emission portion 30 in which multiple emission ports 32 through which atomic beams can be emitted are formed. The emission portion 30 is formed in a portion of a surface of the tubular body. The cathode 420 is housed inside a casing 60 that has an open portion corresponding to this emission portion 30. The cathode 420 also includes a supply portion 36 in a surface opposite the emission portion 30. Each of the first anode 140 and the second anode 150 has both ends respectively fixed to one end and the other end of the cathode 420 with an insulating member 62 therebetween.

The cathode 420 of the atomic beam source 410 includes a catching portion 422 that catches sputter particles and a discharge portion 424 that is connected to the catching portion 422 and configured to discharge the sputter particles to outside. When the atomic beam source 410 is in operation, a discharge pipe and the like are connected to the discharge portion 424 and sputter particles are discharged to an appropriate location, such as outside the process chamber. The discharge portion 424 may be connected to a suction device or the like either directly or via a discharge pipe; however, when the pressure inside the cathode 420 is higher than the pressure outside with the discharge portion 424 therebetween, sputter particles can be discharged from the discharge portion 424 to outside without using a suction device or the like.

The catching portion 422 is preferably formed in a portion where sputter particles are likely to be deposited, for example, corners if the inner side of the cathode 420 is formed into a shape, such as a polygonal shape, that has corners in a cross section perpendicular to the axis direction of the cathode 420. The catching portion 422 has an inlet opening through which sputter particles enter from inside the cathode 420 and this inlet opening is preferably narrower than inside the catching portion 422. As a result, the sputter particles caught in the catching portion 422 are less likely to fall off or scatter toward the interior of the cathode 420.

The shape of the catching portion 422 in a cross section perpendicular to the axis direction of the cathode 420 may be circular, elliptic, or polygonal such as triangular, rectangular, pentagonal, or hexagonal, or may be any other shape with an opening formed in some part. The opening preferably has an angle θ of 90° or more and 180° or less formed between two straight lines that connect the center of the shape (without an opening) of the cross section to the opening portion. The dimensions of the catching portion 422 are preferably 5 mm or more, more preferably 10 mm or more, and yet more preferably 15 mm or more in the height direction and the width direction (diameter in the case of a circle). These dimensions may be 70 mm or less, and are preferably 35 mm or less, more preferably 30 mm or less, and yet more preferably 25 mm or less. For example, when the cross section of the catching portion 422 has a circular shape with an opening formed in some part, the diameter D of this circle is preferably 10 mm or more and 70 mm or less, and the radius r of this circle is preferably 5 mm or more and 35 mm or less. The catching portion 422 may be continuously formed to have a constant cross-sectional shape or varying cross-sectional shape in the length direction, may be formed intermittently, or may be formed in some part.

The cathode 420 can be the same as the cathode 20 except that the cathode 420 includes the catching portion 422 and the discharge portion 424.

According to the atomic beam source 410 described above, the shape of the cathode 420 is predetermined. Specifically, the cathode 420 includes the catching portion 422 and the discharge portion 424. Thus, sputter particles are collected in the catching portion 422 and appropriately discharged through the discharge portion 424 so that deposition of the sputter particles and falling or scattering of the deposited sputter particles can be reduced. As a result, emission of unnecessary particles can be reduced.

Fifth Embodiment

Figure 8:
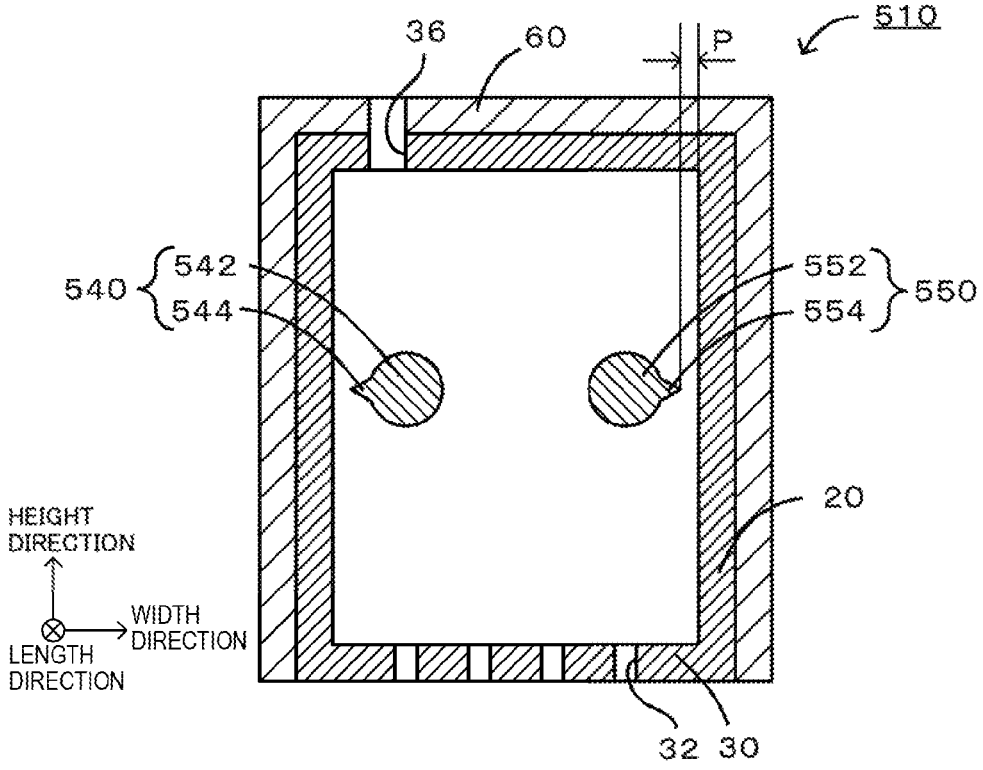
FIG. 8 is a cross-sectional view of an atomic beam source 510, which is an example of a fifth embodiment, and is equivalent to FIG. 2.

FIG. 8 is a cross-sectional view of an atomic beam source 510, which is an example of a fifth embodiment, and is equivalent to FIG. 2. The same structure as that of the atomic beam source 10 is referred to by the same reference numeral and the detailed description therefor is omitted.

As illustrated in FIG. 8, the atomic beam source 510 includes a tubular cathode 20 having both ends closed, a rod-shaped first anode 540 disposed inside the cathode 20, and a rod-shaped second anode 550 disposed inside the cathode 20 and spaced from the first anode 540. The cathode 20 includes an emission portion 30 in which multiple emission ports 32 through which atomic beams can be emitted are formed. The emission portion 30 is formed in a portion of a surface of a tubular body. The cathode 20 is housed in a casing 60 having an open portion corresponding to the emission portion 30. The cathode 20 also includes a supply portion 36 in a surface opposite the emission portion 30. Each of the first anode 540 and the second anode 550 has both ends respectively fixed to one end and the other end of the cathode 20 with an insulating member 62 therebetween.

The first anode 540 and the second anode 550 of the atomic beam source 510 respectively include projections 544 and 554 on the sides opposite to the sides on which main bodies 542 and 552 face each other. The shape, dimensions, material, and arrangement of the main bodies 542 and 552 may be the same as those of the first anode 40 and the second anode 50. The projections 544 and 554 may have a sharp tip, a rounded tip, or a flat tip. The projections 544 and 554 may be continuously formed to have a constant cross-sectional shape or varying cross-sectional shape in the length direction, may be formed intermittently, or may be formed in some part. The projections 544 and 554 are preferably formed so that the distance P between the tip and the cathode 20 is 0.5 mm or more and 5 mm or less, more preferably 0.5 mm or more and 3 mm or less, and yet more preferably 0.5 mm or more and 2 mm or less. The height of the projections 544 and 554 is preferably 0.5 mm or more and 3 mm or less, more preferably 1 mm or more and 3 mm or less, and yet more preferably 2 mm or more and 3 mm or less.

The first anode 540 and the second anode 550 may be arranged parallel to each other so that the center axes of the main bodies 542 and 552 are on a particular installation plane parallel to the emission portion 30. At least one of the center axes may be arranged to incline in the vertical direction with respect to the installation plane P, for example, and/or at least one of the center axes may be arranged to incline in the width direction with respect to a plane perpendicular to the width direction, for example. The slope of the center axis with respect to the installation plane P may be, for example, 0° or more and 10° or less. The slope of the center axis with respect to the plane perpendicular to the width direction may be, for example, 0° or more and 10° or less.

In the atomic beam source 510 described above, the shape of the first anode 540 and the second anode 550 is predetermined. Specifically, the first anode 540 and the second anode 550 respectively have the projections 544 and 554 on the sides opposite to the sides on which the first anode 540 and the second anode 550 face each other. With this atomic beam source 510, plasma is generated and atomic beams can be emitted at a relatively low voltage due to electric field concentration compared to when no projections 544 and 554 are provided. At a low voltage, the cation travelling speed decreases, sputter particles are not readily generated even when cations collide with the cathode 20, the first anode 540, or the second anode 550, and generation of sputter particles is directly reduced. As a result, emission of unnecessary particles can be reduced.

Sixth Embodiment

Figure 9:
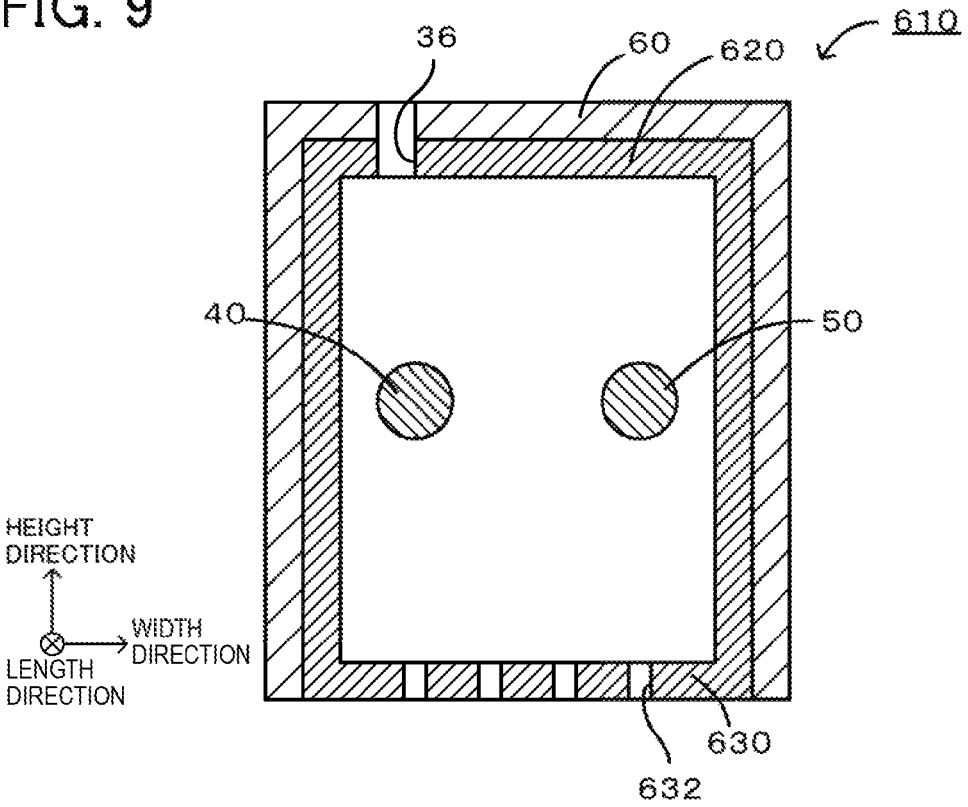
FIG. 9 is a cross-sectional view of an atomic beam source 610, which is one example of a sixth embodiment, and is equivalent to FIG. 2.
Figure 10:
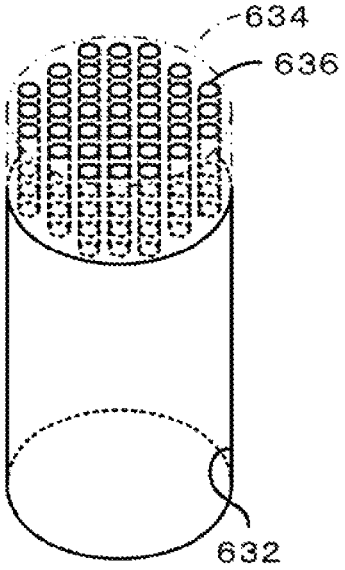
FIG. 10 is a perspective view of emission ports 632 of the atomic beam source 610.

FIG. 9 is a cross-sectional view of an atomic beam source 610, which is one example of a sixth embodiment, and is equivalent to FIG. 2. FIG. 10 is a perspective view of emission ports 632 of the atomic beam source 610. In FIG. 10, the two-dot chain line indicates an imaginary border line with a main body portion of an emission portion 630. The structure identical to that of the atomic beam source 10 or 110 is referred to by the same reference numeral and detailed description therefor is omitted.

As illustrated in FIG. 9, the atomic beam source 610 includes a tubular cathode 620 having both ends closed, a rod-shaped first anode 140 disposed inside the cathode 620, and a rod-shaped second anode 150 disposed inside the cathode 620 and spaced from the first anode 140. The cathode 620 includes an emission portion 630 in which multiple emission ports 632 through which atomic beams can be emitted are formed. The emission portion 630 is formed in a portion of a surface of the tubular body. The cathode 620 is housed inside a casing 60 having an opening portion corresponding to the emission portion 630. The cathode 620 also includes a supply portion 36 in a surface opposite the emission portion 630. Each of the first anode 140 and the second anode 150 has both ends respectively fixed to one end and the other end of the cathode 620 with an insulating member 62 therebetween.

As with the atomic beam source 310 of the third embodiment, with the atomic beam source 610, the emission ports 632 formed in the emission portion 630 of the cathode 620 are formed to have a tendency in which the opening area decreases from the outer surface toward the inner surface of the cathode 620. However, the tendency in which the opening area decreases from the outer surface toward the inner surface of the cathode 620 is formed by providing a filter portion on the side close to the inner surface of the cathode 620, and this is the difference from the atomic beam source 310. In this atomic beam source 610, as illustrated in FIG. 10, a filter portion 634 of each emission port 632 of the emission portion 630 of the cathode 620 is formed on the side close to the inner surface of the cathode 620. This filter portion 634 has two or more small openings 636 which have a smaller opening area than the emission port 632. The shape of the openings 636 of the filter portion 634 may be circular, elliptic, or polygonal such as triangular, rectangular, pentagonal, or hexagonal, or may be any other shape. The dimensions of the openings 636 in the filter portion 634 are preferably 0.01 mm or more and 0.1 mm or less, more preferably 0.01 mm or more and 0.08 mm or less, and yet more preferably 0.03 mm or more 0.06 mm or less in the width direction and the length direction (diameter in the case of a circle). The openings 636 of the filter portion 634 may have a slit shape. In the case of the slit shape, the slit preferably has a width of 0.01 mm or more and 0.1 mm or less. The direction in which the slit extends is not particularly limited. The thickness of the filter portion 634 may be any as long as it is less than the thickness of the emission portion 630 and is preferably, for example, 0.1 mm or more and 3 mm or less, more preferably 0.3 mm or more and 2 mm or less, and yet more preferably 0.5 mm or more and 1 mm or less. Examples of the material for the filter portions 634 may be the same as those for the cathode 20. The material for the filter portion 634 may be the same as or different from that for the emission portion 630. The filter portion 634 is preferably integral with the emission portion 630.

The shape of the emission ports 632 can be the same as that of the emission ports 32 except for the filter portion 634. The shape, dimensions, and position of the emission portion 630 can be the same as those for the emission portion 30 except for the emission ports 632. The shape, dimension, material, etc., for the cathode 620 can be the same as those for the cathode 20 except for the emission portion 630 and the emission ports 632.

In the atomic beam source 610 described above, the shape of the cathode 620 is predetermined. Specifically, emission ports 632 are formed in the emission portion 630 of the cathode 620 and each emission port 632 is equipped with a filter portion 634 on the side close to the inner surface of the cathode 620. As a result, according to the atomic beam source 610, emission of sputter particles can be reduced at the filter portions 634 at the inner surface side. Since atoms and ions are less likely to collide with the emission ports 632 due to absence of the filter portion 634 on the outer surface side, the decrease in the atomic beam output efficiency can be reduced. As a result, emission of unnecessary particles can be reduced.

It will be appreciated that the present invention is not limited by the embodiments described above and the present invention can be implemented in various modes without departing from the technical scope of the present invention.

For example, in the embodiments described above, the first to sixth embodiments are separately described. Alternatively, two or more of the first to sixth embodiments may be combined. In the embodiments described above, the atomic beam sources 10 to 610 are described as having a casing 60. Alternatively, the casing 60 may be omitted. In the embodiments described above, the cathodes 20 to 620 are described as having a tubular shape having both ends closed. Alternatively, one end of the tubular body may be open while the other end is closed, or both ends of the tubular body may be open. In such a case, the openings of the cathodes 20 to 620 are covered by the casing 60. In the embodiments described above, the first anodes 40 to 540 and the second anodes 50 to 550 all have their both ends fixed to one end and the other end of the cathodes 20 to 620 with the insulating members 62 therebetween. However, the structure is not limited to this. At least one of the first anode 40 to 540 and the second anode 50 to 550 may be fixed to only one end of the cathode 20 to 620 either through the insulating member 62 or by any other method. In the embodiments described above, Ar gas is described as an example of the source gas but the source gas may be He, Ne, Kr, Xe, $O_2$, $H_2$, $N_2$, or the like. The source gas is described as being supplied from the supply portion 36; alternatively, the source gas may be supplied to the interior of the cathodes 20 to 620 beforehand. In this case, the supply portion 36 can be omitted.

EXAMPLES

Experimental examples in which the atomic beam sources according to the present invention were used to generate atomic beams are described below. Experimental Examples 1-2, 1-5, 1-8, 1-11, 1-12, 2-2 to 2-7, 3-2 to 3-5, 4-2, 4-3, 5-1, and 5-2 are the examples of the present invention. Experimental Examples 1-1, 1-3, 1-4, 1-6, 1-7, 1-9, 1-10, 2-1, 3-1, 4-1, 5-3, and 5-4 are comparative examples.

Experimental Examples 1-1 to 1-12

In Experimental Examples 1-1 to 1-12, the atomic beam source 10 illustrated in FIGS. 1 to 3 was used. A tubular carbon cathode having both ends closed was used as the cathode 20. In a cross section perpendicular to the axis direction of the cathode 20, the shape of the carbon cathode 20 was rectangular and the dimensions on the inner side were 60 mm in height, 50 mm in width, 100 mm in length, and 5 mm in thickness. The emission portion 30 had emission ports 32 having a diameter of 2 mm. The number of the emission ports 32 was 10 in the width direction and 15 in the length direction. Rod-shaped carbon electrodes having a diameter of 10 mm and a length of 120 mm were used as the first anode 40 and the second anode 50. The distance L between the centers of the first anode 40 and the second anode 50, the distance H between the installation plane P and the emission portion 30, and the value of $(H+L)\times H^2/L$ were as indicated in Table 1. This atomic beam source 10 was placed in the process chamber kept at a vacuum of $10^{-6}$ Pa, and a Si substrate, i.e., a workpiece, was irradiated with an atomic beam. During irradiation, a 100 mA current with a voltage of 1000 V was applied from a high-voltage DC power source connected to the cathode 20, the first anode 40, and the second anode 50. Ar gas serving as a source gas was supplied from the supply portion 36 at 30 cc/min.

TABLE 1

| | L mm | H mm | $(H + L)*H^2/L$ — | Evaluation results* Beam irradiation | Particles |
|---|---|---|---|---|---|
| Experimental Example 1-1 | 35 | 30 | 1671 | C | C |
| Experimental Example 1-2 | 35 | 25 | 1071 | B | B |
| Experimental Example 1-3 | 35 | 20 | 629 | D | — |
| Experimental Example 1-4 | 30 | 30 | 1800 | C | C |
| Expermental Example 1-5 | 30 | 25 | 1146 | B | B |

TABLE 1-continued

| | L mm | H mm | $(H + L)*H^2/L$ — | Evaluation results* Beam irradiation | Particles |
|---|---|---|---|---|---|
| Experimental Example 1-6 | 30 | 20 | 667 | D | — |
| Experimental Example 1-7 | 25 | 30 | 1980 | C | C |
| Experimental Example 1-8 | 25 | 25 | 1250 | B | B |
| Experimental Example 1-9 | 25 | 20 | 720 | D | — |
| Experimental Example 1-10 | 15 | 30 | 2700 | C | C |
| Experimental Example 1-11 | 15 | 25 | 1667 | B | B |
| Experimental Example 1-12 | 15 | 20 | 933 | A | A |

*A: Excellent. B: Good. C: Fair (same as existing model). D: Unacceptable. —: Not evaluated Table 1 shows the evaluation results about unnecessary particles (carbon particles, hereinafter simply referred to as "particles") upon checking the substrate surface and evaluation results of beam (atomic beam) irradiation. Evaluation about particles was carried out by analyzing the substrate surface with a particle counter and comparing the amount of particles with an existing model (for example, Experimental Example 1-1). Samples with significantly fewer particles than the existing model were rated "A", samples with fewer particles than the existing model were rated "B", samples with about the same number of particles as the existing model were rated "C", and samples with more particles than the existing model were rated "D". For evaluation of beam irradiation, the etching rate was measured with a thickness meter and the reading was compared with the etching rate of the existing model. In the table, samples with a significantly higher etching rate than the existing model were rated "A", samples with a higher etching rate than the existing model were rated "B", samples with about the same etching rate as the existing model were rated "C", and samples with a lower etching rate than the existing model were rated "D". As shown in Table 1, the evaluation results regarding beam irradiation and particles were better in Experimental Examples 1-2, 1-5, 1-8, 1-11, and 1-12, in which the $(H+L)\times H^2/L$ was 750 or more and 1670 or less, than the existing model. This showed that according to the first embodiment, emission of unnecessary particles could be reduced. This also showed that the value of $(H+L)\times H^2/L$ was preferably 750 or more, more preferably 800 or more, and yet more preferably 850 or more. The value of the $(H+L)\times H^2/L$ was preferably 1670 or less, more preferably 1050 or less, and yet more preferably 1000 or less.

Experimental Examples 2-1 to 2-7

Experimental Example 2-1 was the same as Experimental Example 1-1. In Experimental Examples 2-2 to 2-4, the atomic beam source 110 illustrated in FIG. 4 was used. In Experimental Examples 2-5 to 2-7, the atomic beam source 210 illustrated in FIG. 5 was used. For the cathodes 120 and 220, the corners of the cathode 20 in Experimental Example 2-1 were altered to have a shape shown in Table 2. The experiment was conducted while other conditions were the same as those of Experimental Example 2-1. In Table 2, R5 indicates an R surface with a 5 mm radius and C5 indicates a chamfer surface having a height and a width of 5 mm each.

TABLE 2

| | Corner shapes | Xmin/Xmax | Evaluation results* Particles |
|---|---|---|---|
| Experimental Example 2-1 | R0 (C0) | 0.67 | C |
| Experimental Example 2-2 | R5 | 0.68 | B |
| Experimental Example 2-3 | R10 | 0.71 | A |
| Experimental Example 2-4 | R15 | 0.76 | A |
| Experimental Example 2-5 | C5 | 0.69 | C |
| Experimental Example 2-6 | C10 | 0.75 | C |
| Experimental Example 2-7 | C15 | 0.79 | B |

*A: Excellent, B: Good, C: Fair (same as existmg model), D: Unacceptable

Table 2 shows the evaluation results about particles upon checking the substrate surface. As shown in Table 2, when the corners are edge-truncated, the evaluation results about particles were satisfactory, which showed that emission of unnecessary particles could be suppressed. Thus, according to the second embodiment, emission of unnecessary particles can be reduced. It was also found that the radius of the R surface was preferably 5 mm or more and the height and width of the chamfer surface were preferably 15 mm or more each. Although the rating C was given for the evaluation results about particles in Experimental Examples 2-5 and 2-6, the number of particles was slightly less than Experimental Example 2-1 and this found that a certain effect was obtained in these examples.

Figure 11:
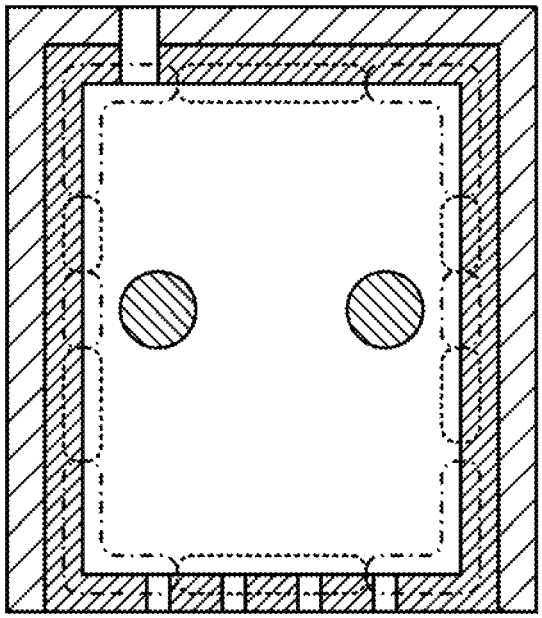
FIG. 11 is a schematic diagram illustrating the state of the interior of a typical atomic beam source after operation.
Figure 12:
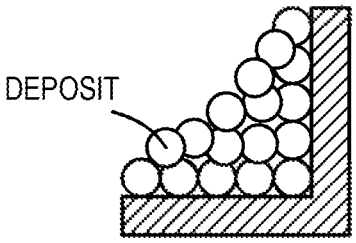
FIG. 12 is a schematic diagram illustrating the state of deposits at a corner of a typical atomic beam source.
Figure 13:
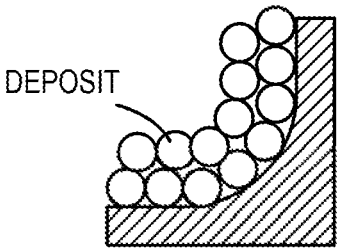
FIG. 13 is a schematic diagram illustrating the state of deposits at a corner with an R surface.

FIG. 11 is a schematic diagram illustrating the state of the interior of a typical atomic beam source after operation. FIG. 12 is a schematic diagram illustrating the state of deposits (sputter particles) at a corner of a typical atomic beam source. FIG. 13 is a schematic diagram illustrating the state of deposits at a corner with an R surface. In FIG. 11, portions surrounded by one-dot chain lines indicate portions where carbon particles are thickly deposited and portions surrounded by chain lines indicate portions where the cathode 20 is worn extensively. As illustrated in FIGS. 11 and 12, the sputter particles are tend to be deposited on the corner. However presumably since the corner had an edge-truncated shape in Experimental Examples 2-2 to 2-7, concentration of deposition of sputter particles at the corner was reduced as illustrated in FIG. 13. As illustrated in FIG. 11, portions near the plasma (portions other than the corners of the cathode, for example) are tend to be susceptible to wear caused by collision with the cations. However, in Experimental Examples 2-2 to 2-7, the corners had an edge-truncated shape and the distance between the cathode 120 and the plasma was more uniform. Thus presumably the amount of wear was made more uniform. From these viewpoints, namely from the viewpoints of reducing concentration of deposition of sputter particles at corners and making the distance between the cathode and the plasma more uniform, it was presumed that the cathode may have a circular or elliptic shape on the inner side in a cross section perpendicular to the axis direction of the cathode.

It was also found that the cathode is preferably configured so that the distance from the center of the cathode, which is the position close to the center of the plasma, to the inner side of the cathode is as uniform as possible. For example, the value of Xmin/Xmax described above preferably satisfies $0.5 \leq Xmin/Xmax \leq 1$. It was also found that the value of Xmin/Xmax was preferably 0.68 or more and more preferably 0.7 or more. When the edge-truncated shape is a chamfer surface, the value of Xmin/Xmax is preferably larger than 0.75, more preferably 0.77 or more, and yet more preferably 0.79 or more.

Experimental Examples 3-1 to 3-5

In Experimental Examples 3-1 to 3-5, the atomic beam source 310 illustrated in FIG. 6 was used. The angle S of the emission ports 332 of the cathode 320 was adjusted to the value indicated in Table 3 and the diameter of the opening at the inner surface side was set to 0.05 mm. Experiments were conducted while other conditions were the same as those of Experimental Example 1-1.

TABLE 3

| | Slope | Evaluation results* | |
|---|---|---|---|
| | S ° | Beam irradiation | Particles |
| Experimental Example 3-1 | 0 | D | A |
| Experimental Example 3-2 | 3 | D | A |
| Experimental Example 3-3 | 4 | C | A |
| Experimental Example 3-4 | 5 | C | A |
| Experimental Example 3-5 | 6 | C | A |

*A: Excellent, B: Good, C: Fair (same as existing model), D: Unacceptable

Table 3 shows the evaluation results about particles upon checking the substrate surface and evaluation results of beam irradiation. As shown in Table 3, in Experimental Examples 3-3 to 3-5 in which the angle S was 4° or more, the evaluation results of beam irradiation were the same as the existing model and the evaluation results about particles were outstanding. In Experimental Example 3-2 in which the angle S was 3°, the evaluation result of beam irradiation was inferior to that of the existing model but the evaluation result about particles was outstanding. This suggests that the evaluation results about particles can be improved by improving beam irradiation such as by adjusting the emission port diameters and output. Thus, it was found that according to the third embodiment, emission of unnecessary particles can be reduced. It was also found that the angle S is preferably 4° or more and 20° or less. It was assumed that the atomic beam source 610 illustrated in FIG. 9 could obtain similar results to the atomic beam source 310 since, as in the atomic beam source 310, the emission ports 632 in the emission portion 630 of the cathode 620 were formed to have a tendency in which the opening area decreased from the outer surface toward inner surface of the cathode 620.

Experimental Examples 4-1 to 4-3

In Experimental Examples 4-1 to 4-3, the atomic beam source 410 illustrated in FIG. 7 was used. The cathode 420 had a circular catching portion 422 having a radius r indicated in Table 1 and a missing part. The angle θ was 90°. Experiments were conducted while other conditions were the same as those of Experimental Example 1-1.

TABLE 4

| | Radius r mm | Evaluation results* Particles |
|---|---|---|
| Experimental Example 4-1 | 0 | C |
| Experimental Example 4-2 | 5 | B |
| Experimental Example 4-3 | 10 | A |

*A: Excellent. B: Good. C: Fair (same as existing model). D: Unacceptable

The evaluation results about particles upon checking the substrate surface are indicated in Table 4. As indicated in Table 4, in Experimental Examples 4-2 and 4-3, in which the catching portion 422 and the discharge portion 423 were provided, the evaluation results about particles were satisfactory in both cases, which showed that emission of unnecessary particles could be reduced. It was thus found that according to the fourth embodiment, emission of unnecessary particles could be reduced.

Experimental Examples 5-1 to 5-4

In Experimental Examples 5-1 to 5-4, the atomic beam source 510 illustrated in FIG. 8 was used. The anodes 540 and 550 were carbon electrodes each including a rod-shaped main body having a diameter of 10 mm and a projection having a height described in Table 5 and being formed continuously throughout the entire length direction of the anode so that the distance P between the tip of the projection and the cathode was the distance indicated in Table 5. The applied voltage was 800 V. Experiments were conducted while other conditions were the same as those in Experimental Example 1-1.

TABLE 5

| | Distance P mm | Projection height mm | Evaluation results* Beam irradiation | Particles |
|---|---|---|---|---|
| Experimental Example 5-1 | 1 | 2 | B | A |
| Experimental Example 5-2 | 2 | 1 | B | B |
| Experimental Example 5-3 | 3 | 0 | C | C |
| Experimental Example 5-4 | 5 | 0 | C | C |

*A: Excellent, B: Good, C: Fair (same as existing model), D: Unacceptable, —: Not evaluated The evaluation results about particles upon checking the substrate surface and the evaluation results of beam irradiation are indicated in Table 5. As shown in Table 5, in Experimental Examples 5-1 and 5-2 in which projections were formed, the evaluation results about particles and evaluation results of beam irradiation were both satisfactory. This showed that according to the fifth embodiment, emission of unnecessary particles could be reduced. In Experimental Examples 5-3 and 5-4 in which only the distance P was changed without providing projections, the evaluation results about particles and evaluation results of beam irradiation were both about the same as those of the existing model. Thus it was derived that presence of the projections had the effect of improving the evaluation results of beam irradiation and evaluation results about particles in Experimental Examples 5-1 and 5-2.

It will be appreciated that the present invention is not limited by the experimental examples described above and the present invention can be implemented in various embodiments without departing from technical scope of the present invention.

The present application claims priority from Japanese Patent Application No. 2015-168429, filed on Aug. 28, 2015, the entire contents of which are incorporated herein by reference.

What is claimed is:

1. An atomic beam source comprising:

a tubular cathode that includes an emission portion that includes an emission port through which an atomic beam can be emitted;

a rod-shaped first anode disposed inside the cathode; and a rod-shaped second anode disposed inside the cathode and spaced from the first anode, wherein at least one selected from the group consisting of a shape of the cathode, a shape of the first anode, a shape of the second anode, and a positional relationship between the cathode, the first anode, and the second anode is predetermined so that emission of sputter particles resulting from collision of cations, which have been generated by plasma between the first anode and the second anode, with at least one selected from the cathode, the first anode, and the second anode is reduced.

2. The atomic beam source according to claim 1, wherein the first anode and the second anode are arranged parallel to each other so that center axes thereof are positioned on an installation plane parallel to the emission portion, and a value of $(H+L)\times H^2/L$ is within a range of 750 or more and 1670 or less, where L (mm) represents a distance between the center axes of the first anode and the second anode, and H (mm) represents a distance between the installation plane and the emission portion.

3. The atomic beam source according to claim 1, wherein an inner side of the cathode has a rectangular shape with at least one corner having an edge-truncated shape in a cross section perpendicular to an axis direction of the cathode, or has a circular or elliptic shape in the cross section.

4. The atomic beam source according to claim 3, wherein the edge-truncated shape is either an R surface having a radius of 5 mm or more or a chamfer surface having a height and a width of 15 mm or more each.

5. The atomic beam source according to claim 3, wherein, in the cross section of the cathode, a minimum distance Xmin from a center to the inner side and a maximum distance Xmax from the center to the inner side satisfy $0.5 \leq Xmin/Xmax \leq 1$.

6. The atomic beam source according to claim 1, wherein the emission port is formed to have a tendency in which an opening area decreases from an outer surface of the cathode toward an inner surface of the cathode.

7. The atomic beam source according to claim 6, wherein the emission port includes a straight line connecting the outer surface to the inner surface and the straight line has a slope of 4° or more and 20° or less with respect to a direction perpendicular to the emission portion.

8. The atomic beam source according to claim 6, wherein the emission port includes a filter portion disposed at a side close to the inner surface of the cathode so as to have the tendency in which the opening area decreases from the outer surface of the cathode toward the inner surface of the cathode.

9. The atomic beam source according to claim 1, wherein the cathode includes a catching portion configured to catch a sputter component and a discharge portion connected to the catching portion and configured to discharge the sputter component to outside.

10. The atomic beam source according to claim 1, wherein each of the first anode and the second anode includes a projection disposed on a side opposite to a side on which the first anode and the second anode face each other.

* * * * *